US007806557B2

(12) United States Patent
Liu et al.

(10) Patent No.: US 7,806,557 B2
(45) Date of Patent: Oct. 5, 2010

(54) LIGHTING UNIT, RECEPTACLE UNIT, AND ASSEMBLY THEREOF

(75) Inventors: Yen-Fu Liu, Taipei Hsien (TW); Chien-Hung Tsai, Taipei Hsien (TW); Hsuan-Hui Chen, Taipei Hsien (TW)

(73) Assignee: Ledtech Electronics Corp., Taipei County (TW)

( * ) Notice: Subject to any disclaimer, the term of this patent is extended or adjusted under 35 U.S.C. 154(b) by 2 days.

(21) Appl. No.: 11/987,154

(22) Filed: Nov. 28, 2007

(65) Prior Publication Data

US 2009/0135602 A1 May 28, 2009

(51) Int. Cl.
*F21V 1/00* (2006.01)

(52) U.S. Cl. ..... 362/239; 362/275; 362/364; 362/238; 362/227; 362/240

(58) Field of Classification Search ..... 362/239, 362/364, 238, 227, 240, 285, 800, 170
See application file for complete search history.

(56) References Cited

U.S. PATENT DOCUMENTS 6,004,005 A * 12/1999 Demshki, Jr. ..... 362/238
7,494,244 B1 * 2/2009 Van Diep et al. ..... 362/234

* cited by examiner

*Primary Examiner*—Sandra L O'Shea
*Assistant Examiner*—Jessica L McMillan
(74) *Attorney, Agent, or Firm*—Rosenberg, Klein & Lee

(57) ABSTRACT

An assembly of a lighting unit and a receptacle unit includes at least one receptacle unit and at least one lighting unit. The receptacle unit has an outer housing provided with at least one first connection portion and at least one second connection portion electrically connected to the first connection portion in the outer housing. The lighting unit is electrically connected to one of the first and second connection portions of the receptacle unit, so that the lighting unit and the receptacle unit can be independently rotated in relation to each other along a connection axis thereof.

20 Claims, 12 Drawing Sheets

LIGHTING UNIT, RECEPTACLE UNIT, AND ASSEMBLY THEREOF

FIELD OF THE INVENTION

The present invention relates to a lighting unit, a receptacle unit, and an assembly thereof, and more particularly to a lighting unit and a receptacle unit capable of being connected with each other and being rotated independently in relation to each other along a connection axis thereof, so that the lighting unit and the receptacle unit can be independently adjusted to face various directions in different rotation angles.

BACKGROUND OF THE INVENTION

A track lighting system, as disclosed in U.S. Pat. No. 4,688,154, comprises a plurality of track units which can be connected to each other, and a connection means for connecting all of the track units to form a track and for transmitting an electric power through the track. In use, one of the track units on one end of the track can be used to transmit the electric power to another of the track units on the other end of the track. Furthermore, a plurality of track lighting units can be movably and pivotally connected with each of the track units, respectively, while the electric power can be supplied to the track lighting unit via the track units for lighting. Although the track lighting system solves some problems existing in other traditional track lighting systems, there are still some inconvenient disadvantages existing in the track lighting system in use and in installation, as the following:

(1) Installation Inconvenience of the Track Lighting System:

When a user connects each of the track units and the corresponding connection means to constitute the track, the track will be mounted on a location on a wall. However, if the user wants to install each of the track lighting units on the track, the user must insert each of the track lighting units from one end of the track, and then each of the track lighting units must be slid along the track until being slid to a predetermined section of the track, respectively. Alternatively, if the user wants to detach each of the track lighting units from the track, the user must shift each of the track lighting units to one end of the track, and then detach each of the track lighting units from the track, respectively. As a result, when installing or detaching each of the track lighting units, the user still spends much time, resulting in the installation inconvenience; and (2) Usage Inconvenience of the Track Lighting System:

Although the user can optionally slide the track lighting units along the track to adjust a projecting location of the track lighting units, each of the track lighting units only can project a light to one side of the track units on the track. In fact, the projecting location of the track lighting units can not be optionally adjusted, in order to project the light to the other side of the track units on the track. As a result, when the track lighting system is used to satisfy needs of indoor decoration or special illumination, there are still some usage inconveniences, which can not be overcome.

Therefore, it is important for related manufacturers to think how to develop an improved lighting product to overcome the foregoing problems.

SUMMARY OF THE INVENTION

A primary object of the present invention is to provide a lighting unit, which comprises a housing, a lighting element, and a transparent plate, wherein the lighting element is installed in the housing, and the transparent plate is mounted on a light penetrating location on the surface of the housing facing the lighting element, while the surface of the housing is provided with at least one electrical connector. As a result, when the lighting element receives an electric power supplied by one of the electrical connectors, the lighting element can project a light toward the transparent plate. Furthermore, the other electrical connectors of the lighting unit can be connected to other objects (such as another lighting unit or a receptacle unit) for supplying the electric power thereto, wherein the lighting unit and the objects can be independently rotated in relation to each other along a connection axis thereof, so that the lighting unit and the objects can be independently adjusted to face various directions in different rotation angles.

A secondary object of the present invention is to provide a receptacle unit, which comprises an outer housing provided with at least one first connection portion and at least one second connection portion electrically connected to the first connection portion in the outer housing. Each of the first and second connection portions is movably and pivotally connected to one structurally corresponding object (such as a lighting unit or another receptacle unit) for supplying an electric power thereto, wherein the receptacle unit and the objects can be independently rotated in relation to each other along a connection axis thereof, so that the receptacle unit and the objects can be independently adjusted to face various directions in different rotation angles.

A third object of the present invention is to provide an assembly of a lighting unit and a receptacle unit, which comprises at least one lighting unit and at least one receptacle unit, wherein the receptacle unit includes an outer housing provided with at least one first connection portion and at least one second connection portion electrically connected to the first connection portion in the outer housing. Each of the first and second connection portions is movably and pivotally connected to one of the first and second connection portions on another structurally corresponding receptacle unit. The lighting unit comprises a housing, a lighting element, and a transparent plate, wherein the lighting element is installed in the housing, and the transparent plate is mounted on a light penetrating location on the surface of the housing facing the lighting element, while the surface of the housing is provided with at least one electrical connector. When a user connects a plurality of the lighting units and a plurality of the receptacle units in turn, each of the receptacle units and each of the lighting units are connected to each other by the corresponding first and second connection portions and the corresponding electrical connector. As a result, each of the receptacle units and each of the lighting units can be independently rotated in relation to each other along a connection axis thereof, so that each of the lighting units can be independently adjusted to face various directions in different rotation angles for lighting.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
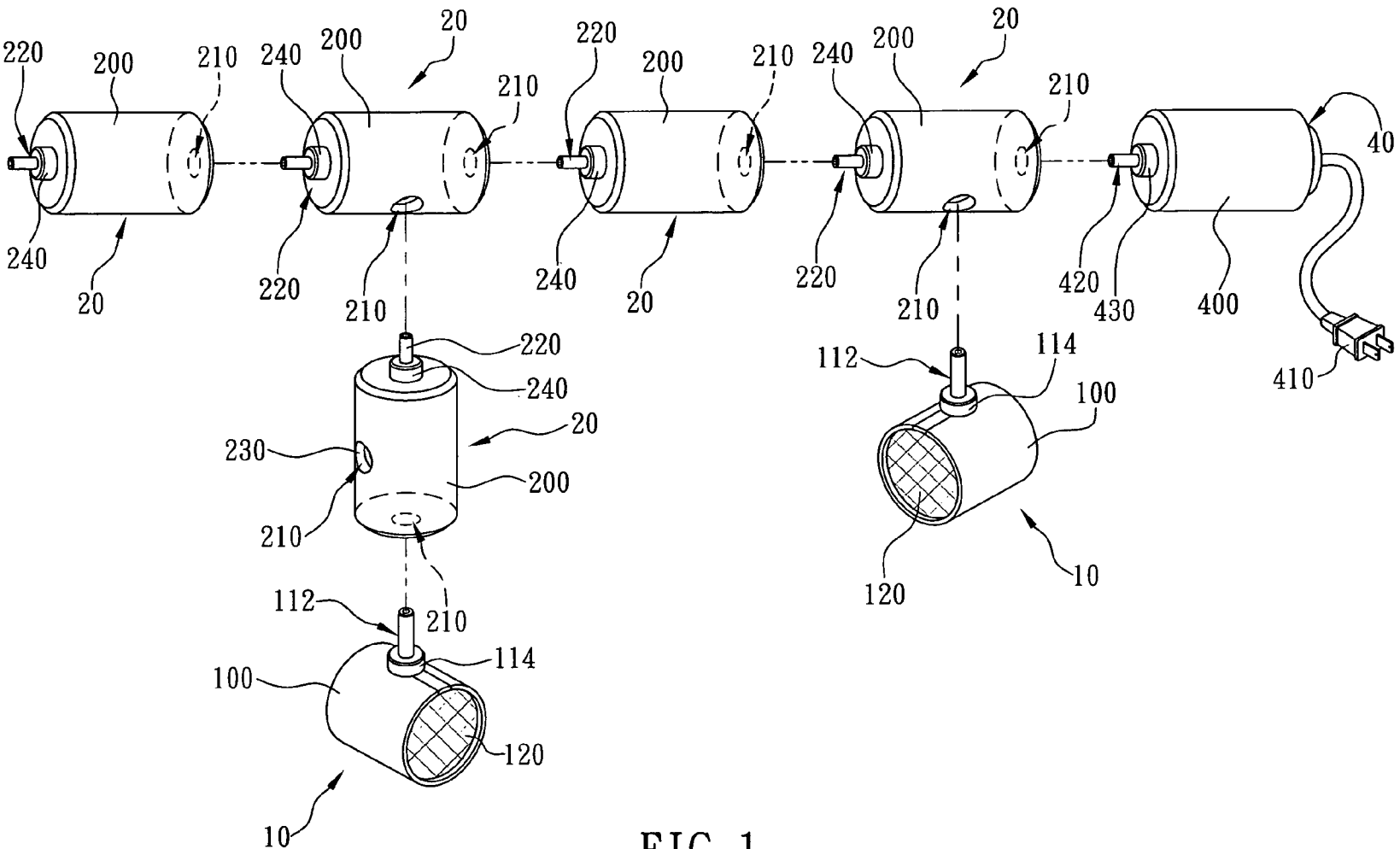
FIG. 1 is an exploded perspective view of an assembly of a receptacle unit, a base, and a lighting unit according to a preferred embodiment of the present invention.
Figure 2:
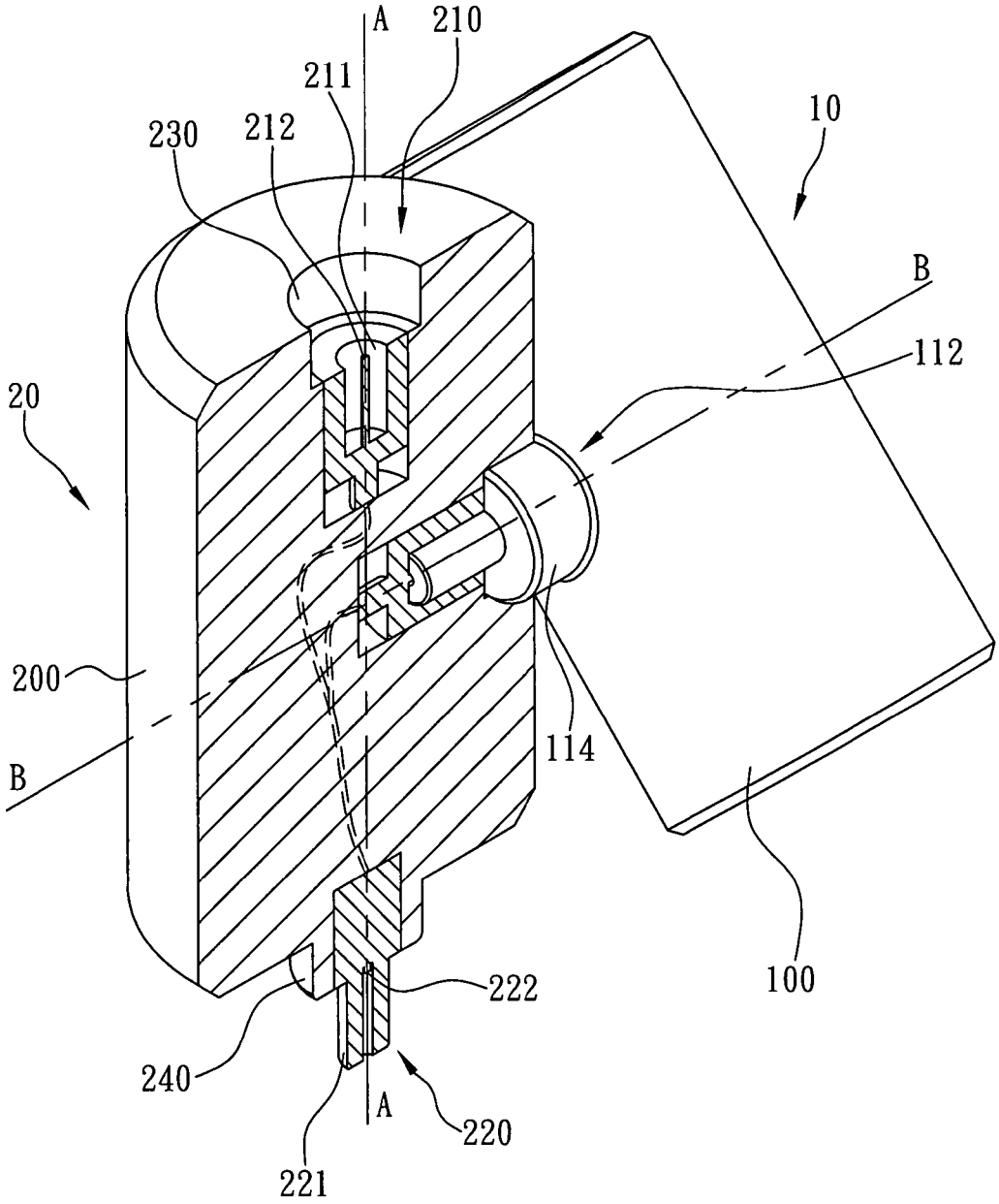
FIG. 2 is a cross-sectional view of the receptacle unit connected to the lighting unit according to the preferred embodiment of the present invention.
Figure 3A:
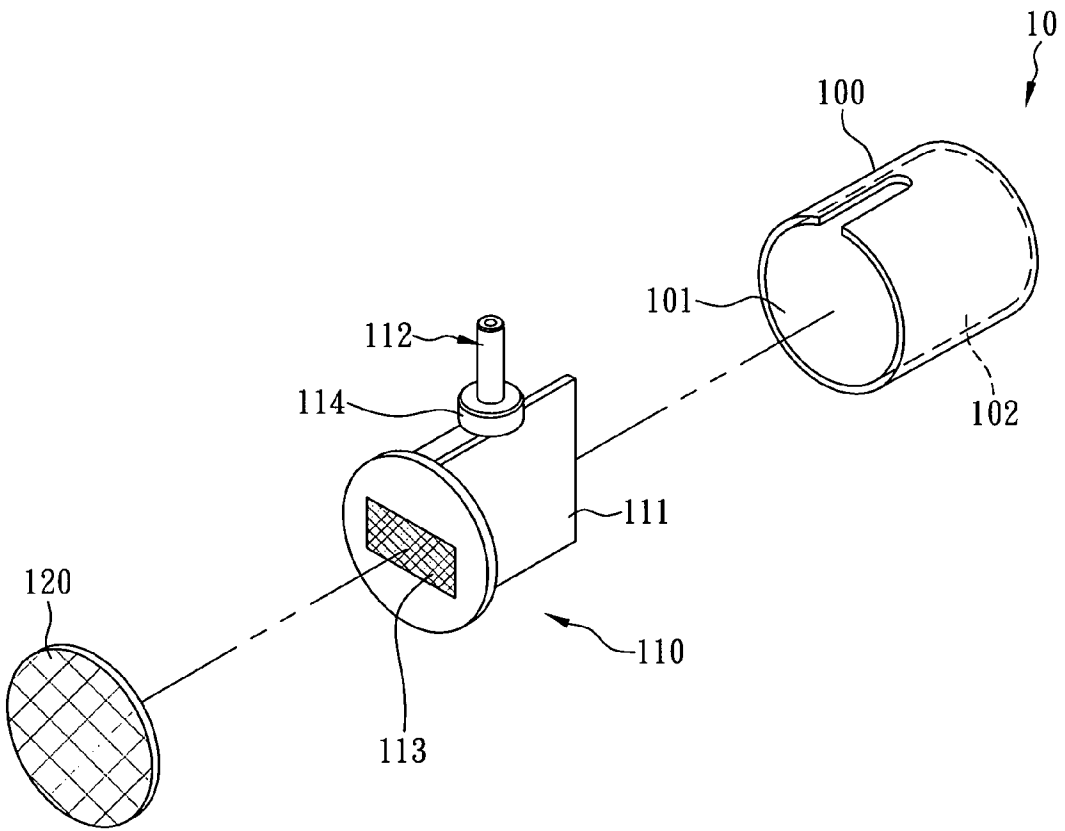
FIG. 3*a* is an exploded perspective view of the lighting unit according to the preferred embodiment of the present invention.
Figure 3B:
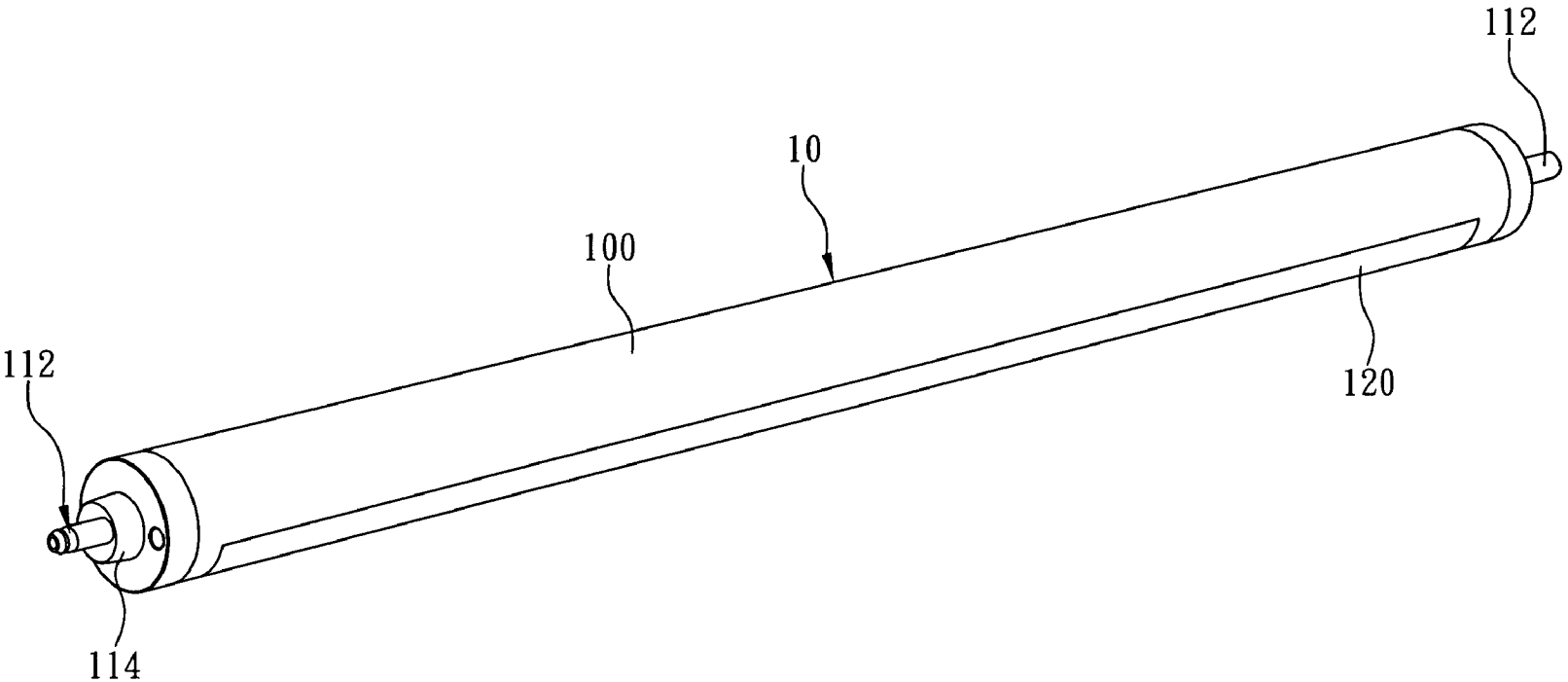
FIG. 3*b* is a perspective view of a lighting unit according to another preferred embodiment of the present invention.

Referring now to FIG. 1, a lighting unit, a receptacle unit, and an assembly thereof according to a preferred embodiment of the present invention are illustrated. As shown, the assembly comprises at least one lighting unit 10 and at least one receptacle unit 20, wherein the receptacle unit 20 has a surface provided with at least one first connection portion 210 and at least one second connection portion 220 which is electrically connected to the first connection portion 210 and the second connection portion 220 in the receptacle unit 20, as shown in FIG. 2. Each of the first and second connection portions 210, 220 is movably and pivotally connected to one of the first and second connection portions 210, 220 on another structurally corresponding receptacle unit 20 for supplying an electric power to the receptacle unit 20. Referring now to FIGS. 3*a* and 3*b*, the lighting unit 10 comprises a housing 100, a lighting element 110, and a transparent plate 120, wherein the lighting element 110 is installed in the housing 100, and the transparent plate 120 is mounted on a light penetrating location on the surface of the housing 100 facing the lighting element 110. Meanwhile the surface of the housing 100 is provided with at least one electrical connector 112, which is electrically connected to the lighting element 110 and one of the first and second connection portions 210, 220.

Figure 4C:
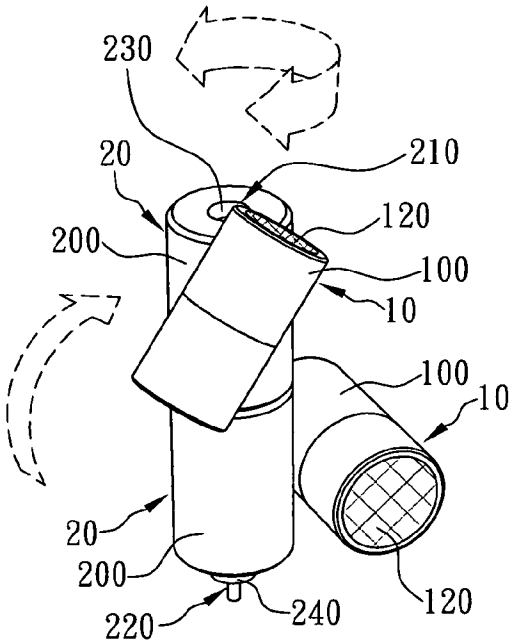
FIG. 4*c* is further another operational view of the assembly of the receptacle unit and the lighting unit according to the preferred embodiment of the present invention.
Figure 4B:
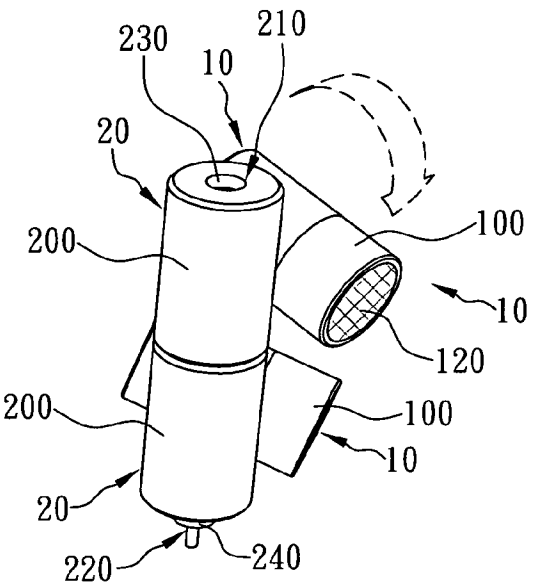
FIG. 4*b* is another operational view of the assembly of the receptacle unit and the lighting unit according to the preferred embodiment of the present invention.
Figure 4A:
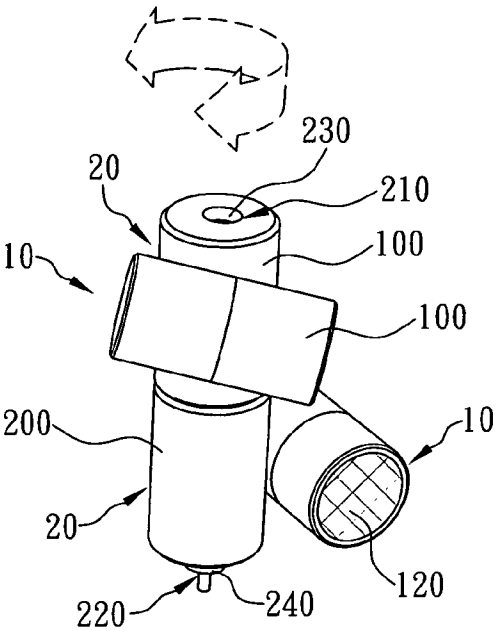
FIG. 4*a* is an operational view of the assembly of the receptacle unit and the lighting unit according to the preferred embodiment of the present invention.

Referring now to FIGS. 2 and 4*a* to 4*c*, when a user connects a plurality of the lighting units 10 and a plurality of the receptacle units 20 in turn, each of the receptacle units 20 and each of the lighting units 10 are connected to each other by the corresponding first and second connection portions 210, 220 and the corresponding electrical connector 112. As a result, each of the receptacle units 20 and each of the lighting units 10 can be independently rotated in relation to another receptacle unit 20 or another lighting unit 10 along a first connection axis A or a second connection axis B. Thus, when each of the receptacle units 20 is connected to each of the lighting units 10, each of the receptacle units 20 can be rotated along the first connection axis A, while the corresponding lighting unit 10 thereon can also be rotated along the first connection axis A, as shown in FIG. 4*a*, so that the lighting unit 10 can provide various angles for lighting outward. Furthermore, the lighting unit 10 can be further rotated along the second connection axis B in relation to the first connection portion 210 on the peripheral wall of the receptacle unit 20, as shown in FIG. 4*b*. The first connection axis A is substantially vertical to the second connection axis B. In use, the lighting unit 10 can be rotated along the second connection axis B, and then further rotated along the first connection axis A with the corresponding receptacle unit 20, as shown in FIG. 4*c*. Therefore, when a plurality of the receptacle units 20 are connected to a plurality of the lighting units 10, the assembly of the lighting units 10 and the receptacle units 20 can provide various assembling statuses at different relative locations in different rotation angles, so as to fully satisfy needs of various lighting directions of the lighting units 10 at various locations. In other words, each of the receptacle units 20 and each of the lighting units 10 can be independently rotated in relation to another connected receptacle unit 20 or another connected lighting unit 10 along a connection axis thereof according to the locations of the first and second connection portions 210, 220 and the electrical connector 112 on the outer housing 200 or the housing 100.

Figure 5A:
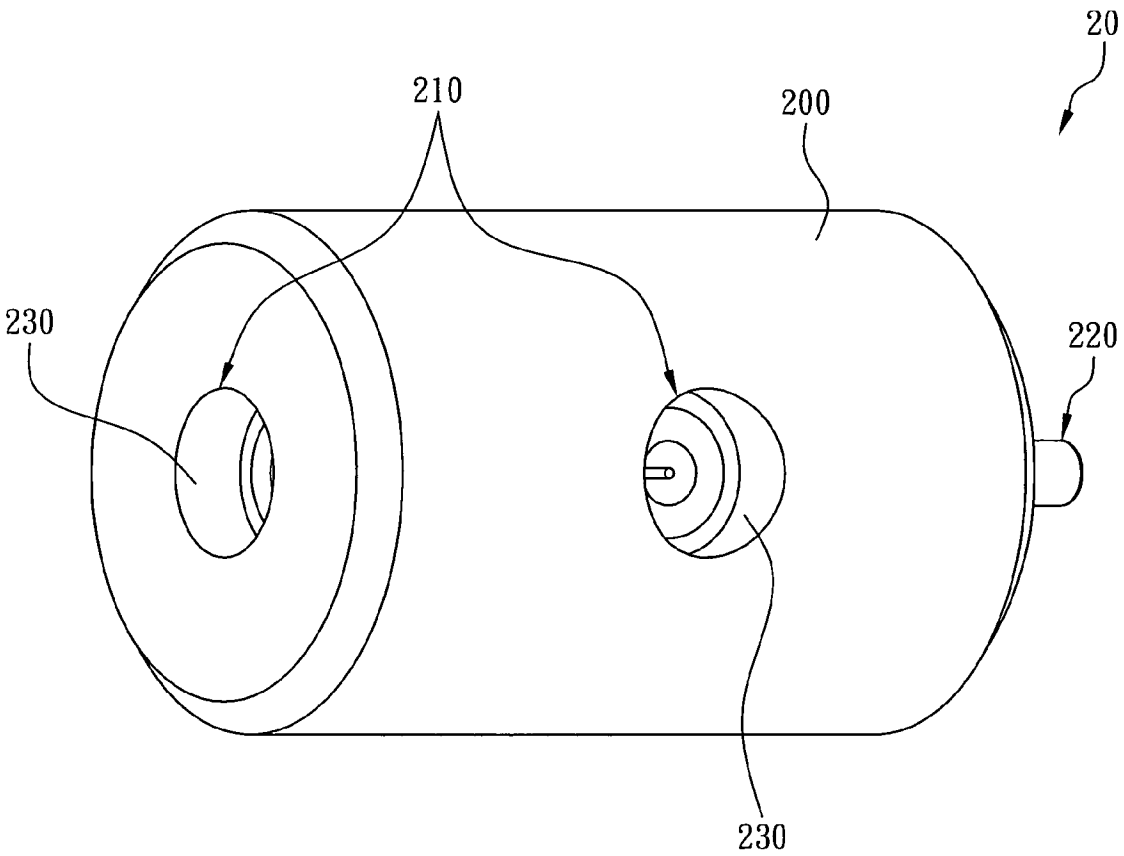
FIGS. 5*a* to 5*g* are perspective views of a lighting unit according to other preferred embodiments of the present invention.

Referring now to FIG. 5*a*, in another preferred embodiment of the present invention, the receptacle unit 20 includes an outer housing 200 having a cylindrical shape, wherein the outer housing 200 has a first end provided with a first connection portion 210, a second end provided with a second connection portion 220, and a peripheral wall between the first and second ends that is provided with another first connection portion 210. The first connection portion 210 is preferably a concave female connector, while the second connection portion 220 is preferably a convex male connector.

Figure 5B:
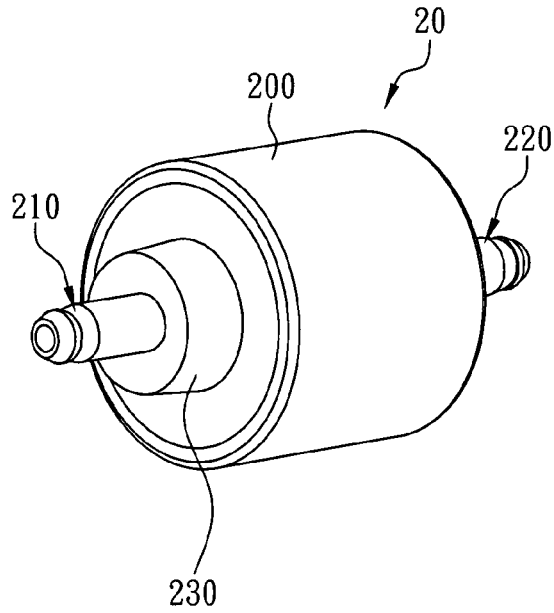

It should be noted that the foregoing preferred embodiment is one of preferred embodiments of the present invention. In alternatively preferred embodiment of the present invention, the outer housing 200 of the receptacle unit 20 can be selected from other shapes. Moreover, the outer housing 200 of the receptacle unit 20 can be provided with a plurality of first connection portions 210 and a plurality of second connection portions 220. Furthermore, the first connection portion 210 can be selected from a convex male connector, while the second connection portion 220 can be selected from a concave female connector. In other words, any receptacle unit 20, which has an outer housing 200 provided with at least two connection portions on the surface thereof and can carry out the independently rotation in relation to another connected receptacle unit 20 or lighting unit 10 along a connection axis thereof, can be also used as a receptacle unit 20 of the present invention. Some examples of the receptacle units 20 of the present invention are described more detailed as the following:

Referring now to FIG. 5*b*, the receptacle unit 20 includes an outer housing 200 having a cylindrical shape, wherein the outer housing 200 has a first end provided with a first connection portion 210, and a second end provided with a second connection portion 220. The first connection portion 210 and the second connection portion 220 is preferably a convex male connector.

Figure 5C:
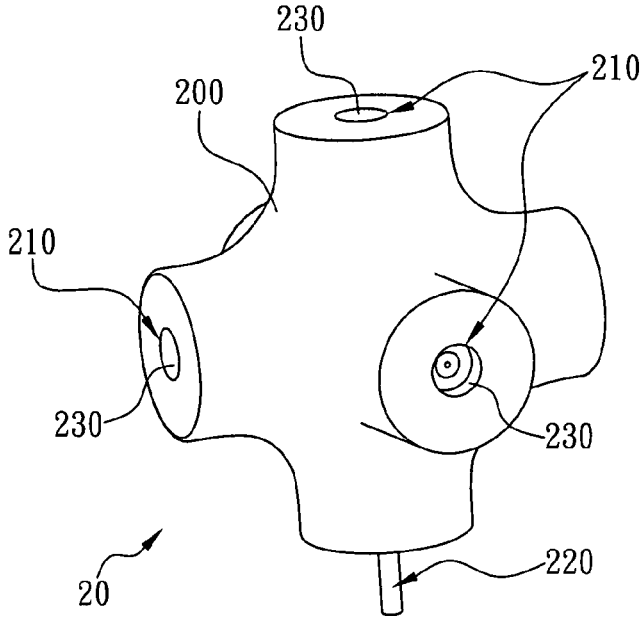

Referring now to FIG. 5*c*, the receptacle unit 20 includes an outer housing 200 having a cross shape, wherein the outer housing 200 has a plurality of side ends respectively provided with a first connection portion 210, an upper end provided with another first connection portion 210, and a lower end provided with a second connection portion 220. Each of the first connection portions 210 is preferably a concave female connector, while the second connection portion 220 is preferably a convex male connector.

Figure 5D:
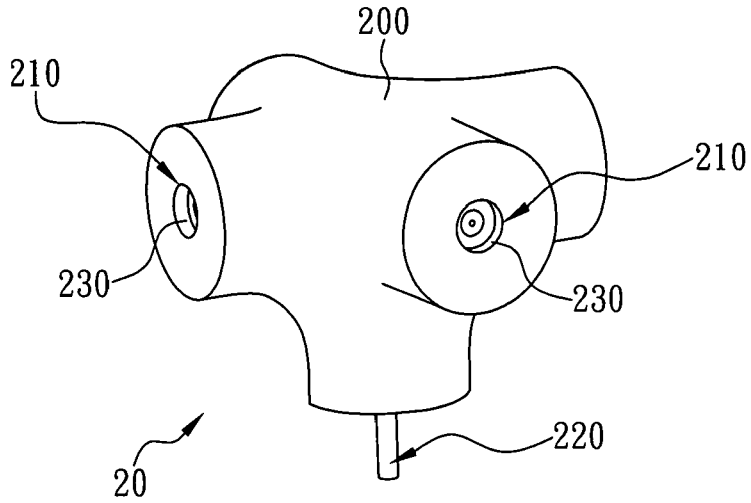

Referring now to FIG. 5*d*, the receptacle unit 20 includes an outer housing 200 having a substantially cross shape, wherein the outer housing 200 has a plurality of side ends respectively provided with a first connection portion 210, and a lower end provided with a second connection portion 220. Each of the first connection portions 210 is preferably a concave female connector, while the second connection portion 220 is preferably a convex male connector.

Figure 5E:
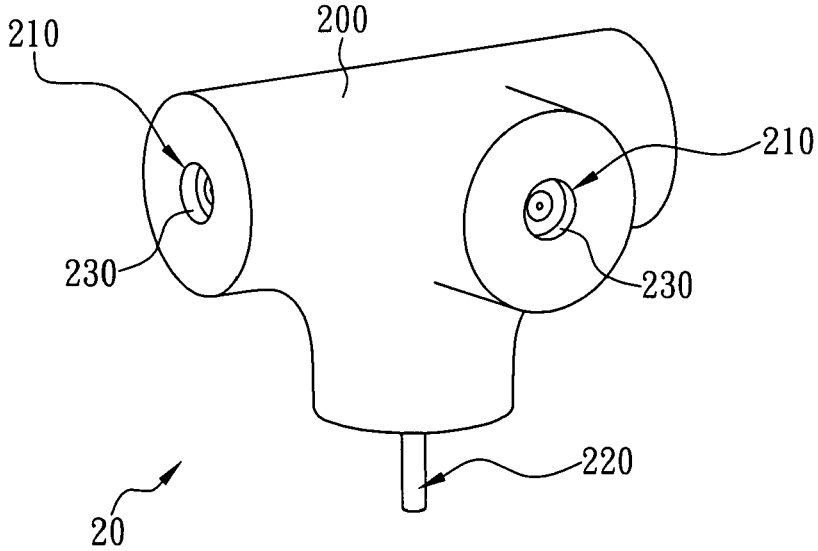

Referring now to FIG. 5*e*, the receptacle unit 20 includes an outer housing 200 having a substantial T-shape, wherein the outer housing 200 has a pair of opposite side ends respectively provided with a first connection portion 210, a front end sandwiched between the opposite side ends and provided with a first connection portion 210, and a lower end provided with a second connection portion 220. Each of the first connection portions 210 is preferably a concave female connector, while the second connection portion 220 is preferably a convex male connector.

Figure 5F:
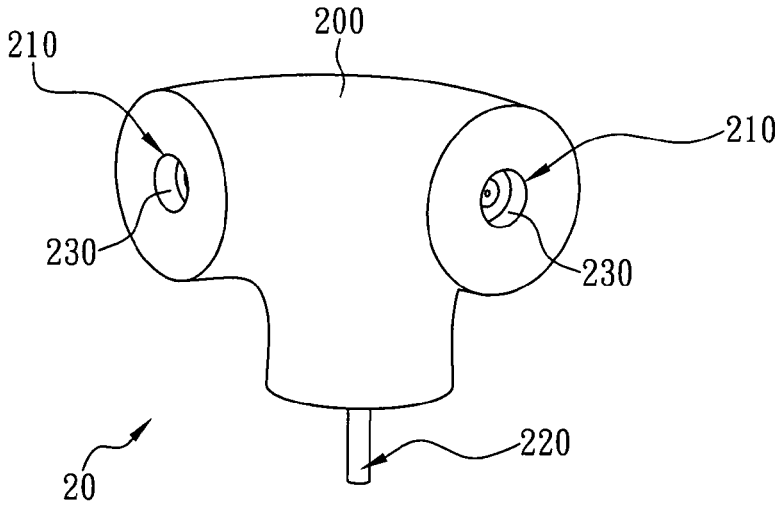

Referring now to FIG. 5*f*, the receptacle unit 20 includes an outer housing 200 having a substantial L-shape, wherein the outer housing 200 has a pair of side ends respectively provided with a first connection portion 210, and a lower end sandwiched between the side ends and provided with a second connection portion 220. Each of the first connection portions 210 is preferably a concave female connector, while the second connection portion 220 is preferably a convex male connector.

Figure 5G:
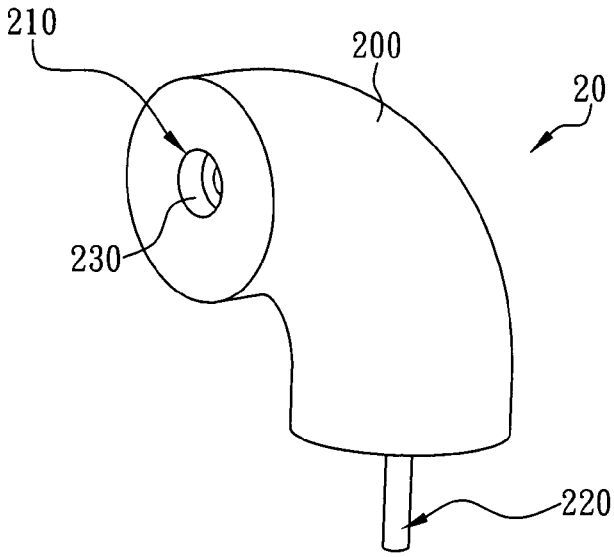

Referring now to FIG. 5*g*, the receptacle unit 20 includes an outer housing 200 having another substantial L shape, wherein the outer housing 200 has a first end provided with a first connection portion 210, and a second end provided with a second connection portion 220. The first connection portion 210 is preferably a concave female connector, while the second connection portion 220 is preferably a convex male connector.

Referring back to FIG. 1, the location of the outer housing 200 connected to the first connection portion 210 is formed with a first engaged portion 230, such as a post or a cavity. Meanwhile, the location of the outer housing 200 connected to the second connection portion 220 is formed with a second engaged portion 240, such as a cavity or a post. Thus, when the receptacle unit 20 is pivotally connected to another adjacent receptacle unit 20, the first engaged portion 230 (or the second engaged portion 240) of the receptacle unit 20 can be engaged with the structurally corresponding second engaged portion 240 (or the first engaged portion 230) of the adjacent receptacle unit 20. Alternatively, the first engaged portion 230 (or the second engaged portion 240) of the receptacle unit 20 can be engaged with the structurally corresponding electrical connector 112 of the lighting unit 10. As a result, the receptacle unit 20 can be stably connected to the adjacent receptacle unit 20 or the lighting unit 10, so that the receptacle unit 20, and the adjacent receptacle unit 20 or the lighting unit 10 can be independently rotated in relation to each other along a connection axis thereof.

Figure 6:
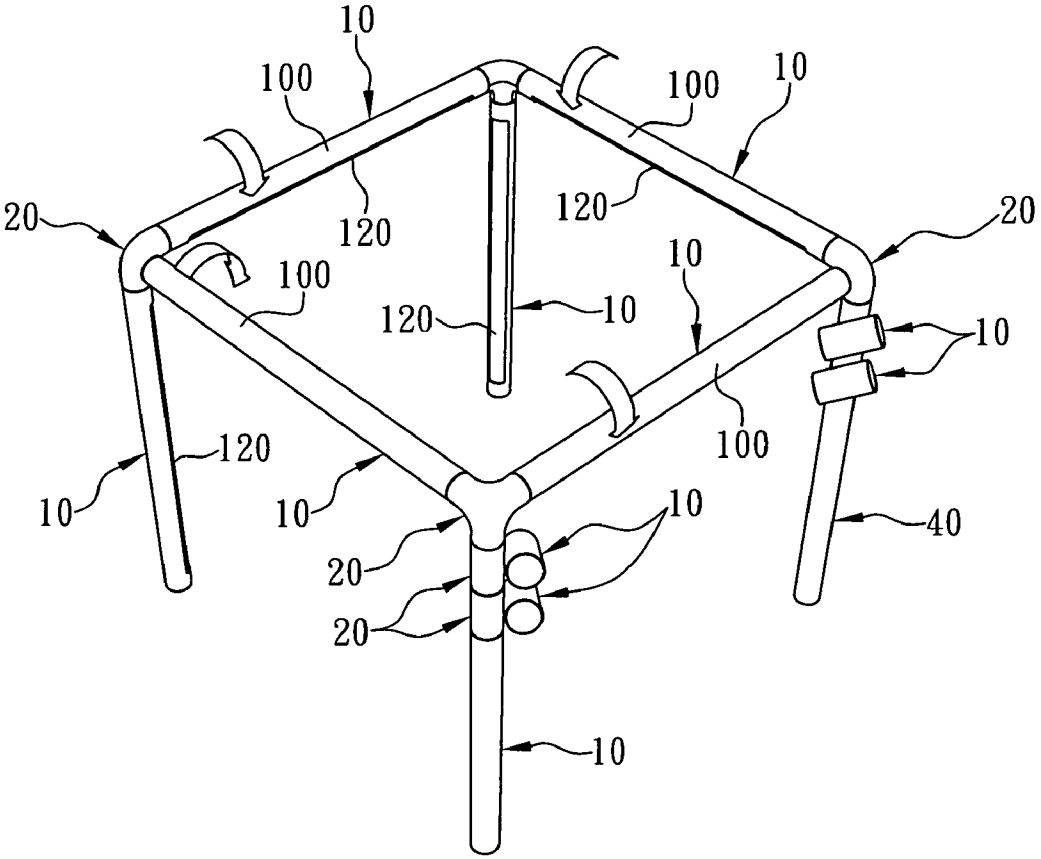
FIG. 6 is an assembled perspective view of an assembly of a receptacle unit, a base, and a lighting unit according to another preferred embodiment of the present invention.

Referring back to FIG. 2, the female connector can be selected from a power receptacle or an earphone receptacle, while the female connector has an inner wall and a central post surrounded by the inner wall. The inner wall is defined as a first negative electrode 211, and the central post is defined as a first positive electrode 212. Furthermore, the male connector can be selected from a power plug (3.5 mm) or an earphone plug (2.5 mm), while the male connector has an outer wall and a central cavity surrounded by the outer wall. The outer wall is defined as a second negative electrode 221, and the central cavity is defined as a second positive electrode 222. The first positive electrode 212 is electrically connected to the second positive electrode 222 in the outer housing 200, while the first negative electrode 211 is also electrically connected to the second negative electrode 221 in the outer housing 200. Thus, when the receptacle unit 20 is pivotally connected to another adjacent receptacle unit 20 or the lighting unit 10, the receptacle unit 20 can supply the electric power to the adjacent receptacle unit 20 or the lighting unit 10. That is to say, the receptacle unit 20 can be used as a means for supplying the electric power, as shown in FIG. 6.

Referring back to FIG. 3*a*, in the preferred embodiment of the present invention, the housing 100 of the lighting unit 10 comprises an opening 101 on one end thereof and a receiving space 102 therein, wherein the receiving space 102 is communicated with the opening 101. The transparent plate 120 is mounted on the opening 101 for covering the opening 101. The lighting element 110 is mounted in the receiving space 102, and provided with a circuit board 111 and a light emitting device 113 (such as a light emitting diode, LED). The light emitting device 113 is electrically connected to the circuit board 111, and mounted on a location of the circuit board 111 in the receiving space 102 facing the transparent plate 120. The electrical connector 112 can be selected from a power plug (3.5 mm) or an earphone plug (2.5 mm), while the electrical connector 112 is mounted on one side of the lighting element 110 and electrically connected to the circuit board 111 of the lighting element 110. Moreover, the electrical connector 112 has one end extended out of one side of the housing 100, in order to be pivotally connected to one of the structurally corresponding first and second connection portions 210, 220 of the receptacle unit 20. As a result, the lighting unit 10 can receive the electric power from the receptacle unit 20, while the lighting unit 10 and the receptacle unit 20 can be independently rotated in relation to each other along a connection axis thereof. Thus, each of the lighting units 10 can provide various angles for lighting outward, as shown in FIGS. 4*a* to 4*c*.

Furthermore, the lighting unit 10 is further formed with a third engaged portion 114 on one end of the electrical connector 112 close to the housing 100. The third engaged portion 114 of the lighting unit 10 is for being engaged with the structurally corresponding first or second engaged portions 230, 240 of the receptacle unit 20. Thus, the lighting unit 10 can be stably connected to the receptacle unit 20, while the lighting unit 10 can be smoothly rotated in relation to the receptacle unit 20.

It should be noted that the foregoing preferred embodiment is one of preferred embodiments of the present invention. In alternatively preferred embodiment of the present invention, the lighting unit 10 is not limited to provide a single electrical connector 112. Moreover, the housing 100 is not limited to provide a single opening on one end thereof. In other words, any lighting unit 10, which has a surface provided with at least one electrical connector 112 for supplying an electric power to another adjacent lighting unit 10 or the receptacle unit 20 therethrough, can be used as a lighting unit 10 of the present invention. For example, referring to FIG. 3*b*, the housing 100 comprises a pair of electrical connectors 112 on two ends thereof, and a transparent plate 120 mounted between the two ends of the housing 100.

Referring back to FIG. 1, in the preferred embodiment of the present invention, one of the receptacle unit 20 and the lighting unit 10 can be connected to a base 40, wherein the base 40 comprises an outer housing 400 having a cylindrical shape. The outer housing 400 of the base 40 has a first end provided with a power receiving portion 410 (such as a male plug or a female socket) for being connected to a power receptacle (not shown), and a second end provided with a power supplying portion 420 (such as a power plug of 3.5 mm or an earphone plug of 2.5 mm) for being connected to one of the first and second connection portions 210, 220. The power receiving portion 410 is electrically connected to the power supplying portion 420 in the outer housing 400. When the base 40 is connected to the receptacle unit 20 or the lighting unit 10, the power receiving portion 410 of the base 40 can be used to transmit an electric power supplied by the power receptacle to the power supplying portion 420, and then the power supplying portion 420 can be electrically connected to the receptacle unit 20 or the lighting unit 10 in turn for providing the electric power to the receptacle unit 20 or the lighting unit 10.

Moreover, the base 40 is further provided with a fourth engaged portion 430 (such as a cavity or a post) at a location thereof connected to the power supplying portion 420. When the receptacle unit 20 is pivotally connected to the base 40, the first or second engaged portion 230, 240 of the receptacle unit 20 can be engaged with the structurally corresponding fourth engaged portion 430 of the base 40. As a result, the receptacle unit 20 can be stably connected to the base 40, so that the receptacle unit 20 can be smoothly rotated in relation to the base 40.

Figure 7:
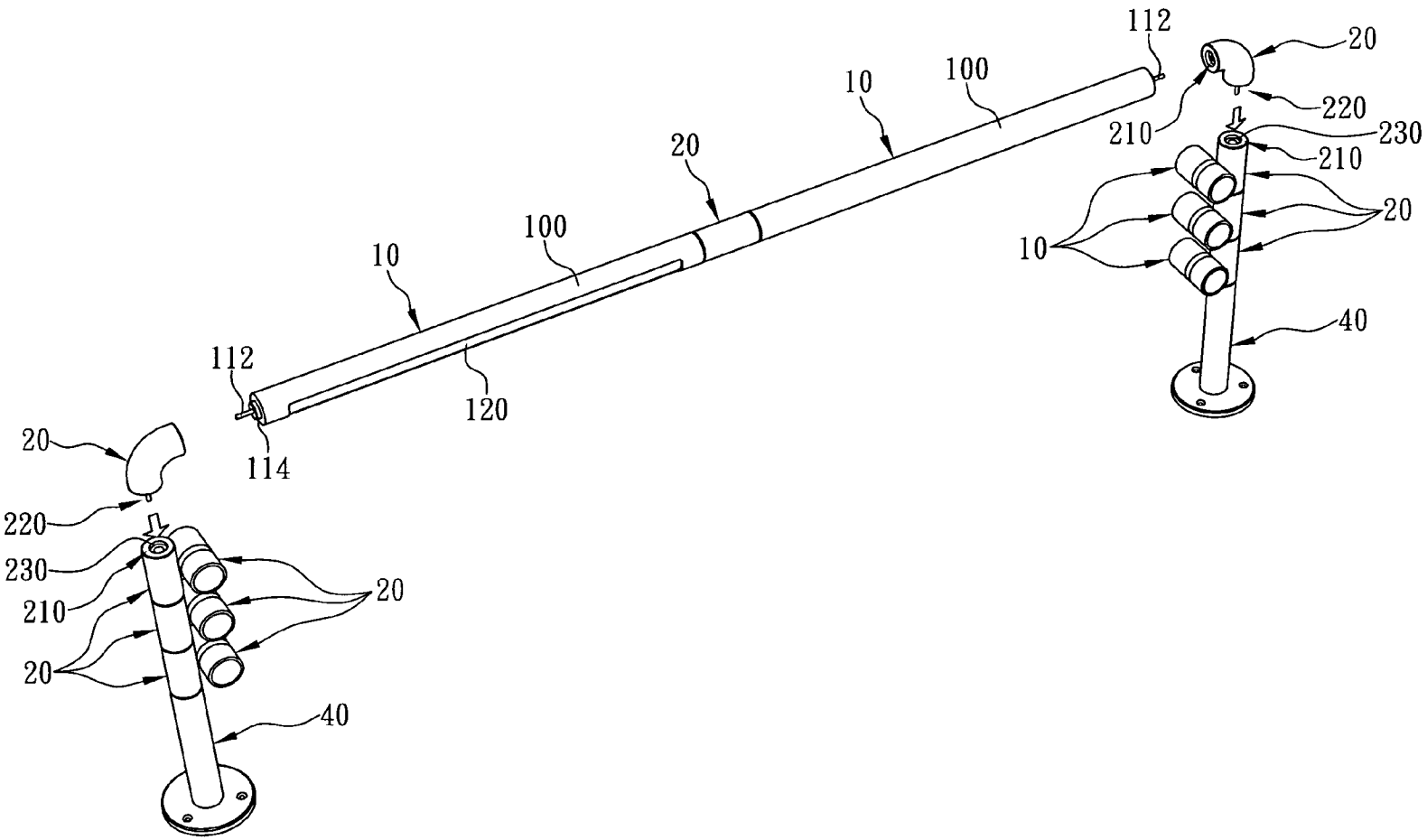
FIG. 7 is a partial exploded/assembled perspective view of an assembly of a receptacle unit, a base, and a lighting unit according to further another preferred embodiment of the present invention.
Figure 8:
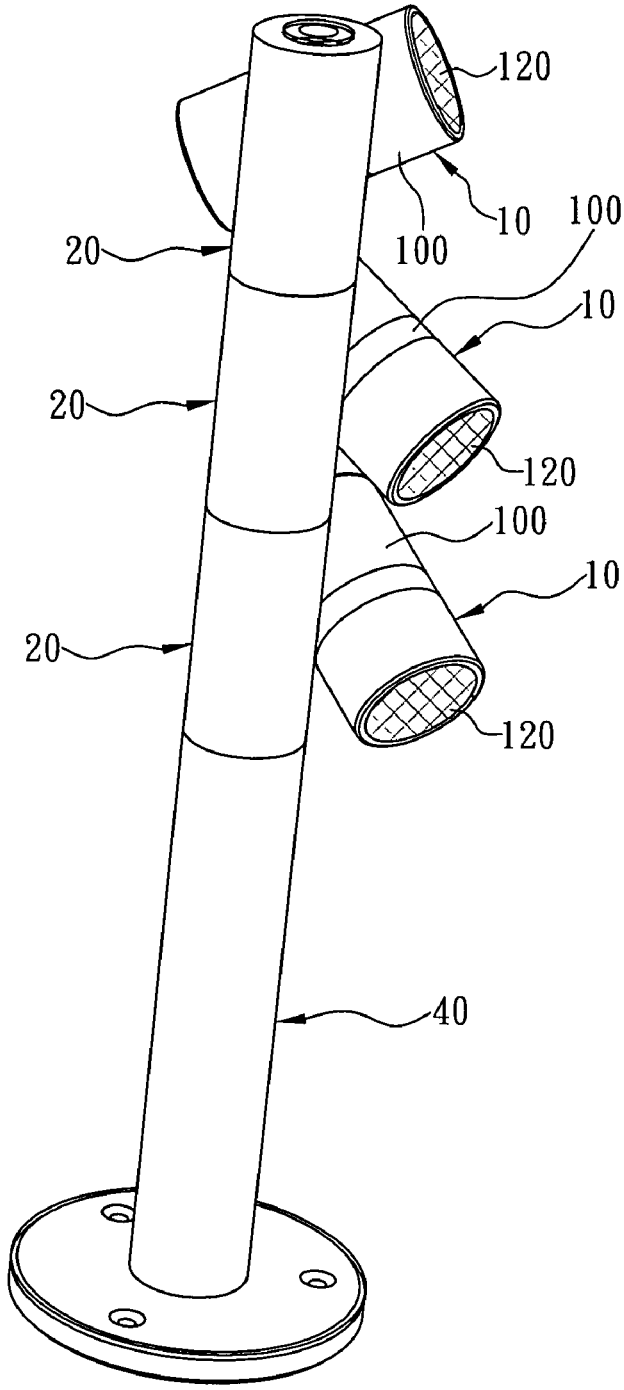
FIG. 8 is an assembled perspective view of an assembly of a receptacle unit, a base, and a lighting unit according to still another preferred embodiment of the present invention.

As described above, in comparison with features of the traditional track lighting system, the present invention further provides functions or purposes as the following:

(1) In the present invention, the lighting unit 10 can be directly connected to (or detached from) the receptacle unit 20, so as to solve the problem of the traditional track lighting system that must insert (or detach) the track lighting unit from one end of the track. Thus, the present invention substantially simplifies the installation of the lighting unit 10 and saves the installation time;

(2) The present invention further solves another problem of the traditional track lighting system that the projection direction of the track lighting unit can not be optionally adjusted for projecting the light to the opposite side of the track units on the track. Thus, the present invention can satisfy needs of indoor decoration or special illumination for projecting the light to various locations in different angles; and (3) Referring to FIGS. 6 to 8, each of the lighting unit 10, the receptacle unit 20, and the base 40 is not limited to be series-connected to each other. Alternatively, each of the receptacle units 20 can be assembled according to environmental needs. For example, the second connection portion 220 of the receptacle unit 20 can be connected to the first connection portion 210 on the peripheral wall of another adjacent receptacle unit 20. In this manner, a user can optionally add another additional receptacle unit 20 or lighting unit 10 on the first connection portion 210 of the receptacle unit 20, so as to form a stable predetermined assembly shape. As a result, the assembly of the present invention can replace the traditional track lighting system, and be able to form various predetermined assembly shapes based on various different operation places, in order to satisfy needs of the operation places.

The present invention has been described with a preferred embodiment thereof and it is understood that many changes and modifications to the described embodiment can be carried out without departing from the scope and the spirit of the invention that is intended to be limited only by the appended claims.

What is claimed is:

1. An assembly of a lighting unit and a receptacle unit, comprising:

a plurality of receptacle units each having a modular structure including an outer receptacle unit housing provided with at least one first connection portion and at least one second connection portion electrically connected to the first connection portion in the outer receptacle unit housing wherein the receptacle units are independently rotatably coupled with each other by connecting the first connection portion with the second connection portion; and at least one lighting unit having a modular structure including an outer lighting unit housing provided with a third connection portion electrically connected to one of the first and second connection portions of the receptacle unit, said lighting unit is rotatably coupled to one of the receptacle units;

wherein the lighting unit and the receptacle unit are independently rotated in relation to each other along a connection axis thereof.

2. The assembly of claim 1, wherein the outer receptacle unit housing of the receptacle unit is cylindrical, and the outer receptacle unit housing has a first end provided with one of the first connection portion, a second end provided with one of the second connection portion, and a peripheral wall between the first and second ends that is provided with one of the first connection portion.

3. The assembly of claim 1, wherein the outer receptacle unit housing of the receptacle unit is cylindrical, and the outer receptacle unit housing has a first end provided with one of the first connection portion, and a second end provided with one of the second connection portion.

4. The assembly of claim 1, wherein the outer receptacle unit housing of the receptacle unit is cross, and the outer receptacle unit housing has a plurality of side ends respectively provided with one of the first connection portion, an upper end provided with one of the first connection portion, and a lower end provided with one of the second connection portion.

5. The assembly of claim 1, wherein the outer receptacle unit housing of the receptacle unit is substantially cross, and the outer housing has a plurality of side ends respectively provided with one of the first connection portion, and a lower end provided with one of the second connection portion.

6. The assembly of claim 1, wherein the outer receptacle unit housing of the receptacle unit is substantially T-shaped, and the outer receptacle unit housing has a plurality of side ends respectively provided with one of the first connection portion, and a lower end provided with one of the second connection portion.

7. The assembly of claim 1, wherein the outer receptacle unit housing of the receptacle unit is substantially L-shaped, and the outer receptacle unit housing has a pair of side ends respectively provided with one of the first connection portion, and a lower end sandwiched between the side ends and provided with one of the second connection portion.

8. The assembly of claim 1, wherein the outer receptacle unit housing of the receptacle unit is substantially L-shaped, and the outer housing has a first end provided with one of the first connection portion, and a second end provided with one of the second connection portion.

9. The assembly of claim 1, wherein the lighting unit comprises:

a lighting unit housing provided with a receiving space therein;

a lighting element installed in the receiving space; and a transparent plate mounted on a light penetrating location located on the lighting unit housing and facing the lighting element, wherein said third connection portion is electrically connected to the lighting element, and has one end extended out of one side of the lighting unit housing.

10. The assembly of claim 9, wherein the lighting element further comprises:

a circuit board electrically connected to said third connection portion; and a light emitting device electrically connected to the circuit board and mounted on a location of the circuit board facing the transparent plate.

11. The assembly of claim 10, wherein the light emitting device is a light emitting diode (LED).

12. The assembly of claim 9, wherein said first connection portion of said receptacle unit is formed with a first engaged portion, and said second connection portion of said receptacle unit is formed with a second engaged portion.

13. The assembly of claim 12, wherein said third connection portion of said lighting unit is formed with a third engaged portion.

14. The assembly of claim 1, further comprising a base, wherein the base comprises:

an outer base housing;

a power receiving portion formed on a first end of the outer base housing; and a power supplying portion formed on a second end of the outer base housing, and electrically connected to the power supplying portion in the outer base housing, wherein the power supplying portion is electrically and pivotally connected to one of the first and second connection portions of the receptacle unit.

15. The assembly of claim 1, wherein the first connection portion is a concave female connector.

16. The assembly of claim 15, wherein the female connector is a power receptacle.

17. The assembly of claim 15, wherein the female connector is an earphone receptacle.

18. The assembly of claim 1, wherein the second connection portion is a convex male connector.

19. The assembly of claim 18, wherein the male connector is a power plug.

20. The assembly of claim 18, wherein the male connector is an earphone plug.

* * * * *